United States Patent [19]

Reinhold

[11] Patent Number: 4,506,637

[45] Date of Patent: Mar. 26, 1985

[54] ROTARY INTERNAL COMBUSTION ENGINE

[75] Inventor: William R. Reinhold, Southport, N.C.

[73] Assignee: Rotorque Associates, Southport and Boiling Spring, N.C.

[21] Appl. No.: 556,895

[22] Filed: Dec. 1, 1983

[51] Int. Cl.[3] ..... F02B 53/00

[52] U.S. Cl. ..... 123/246

[58] Field of Search ..... 123/243, 246, 332, 333

[56] References Cited

U.S. PATENT DOCUMENTS

| | | | |
|---|---|---|---|
| 980,506 | 1/1911 | Ewertz | 123/243 |
| 3,174,274 | 3/1965 | Frye | 123/246 X |
| 3,323,499 | 6/1967 | Gijbeis | 123/246 X |
| 3,377,995 | 4/1968 | de Castelet | 123/242 |
| 3,777,723 | 12/1973 | Lundstrom et al. | 123/246 |
| 3,965,697 | 6/1976 | Beierwaltes | 62/402 |
| 4,003,349 | 1/1977 | Habsburg-Lothringen | 123/246 |
| 4,012,180 | 3/1977 | Berkowitz et al. | 418/141 |

FOREIGN PATENT DOCUMENTS

| | | | |
|---|---|---|---|
| 2057475 | 10/1971 | Fed. Rep. of Germany | 123/246 |
| 2381908 | 9/1978 | France | 123/246 |

*Primary Examiner*—Michael Koczo

*Attorney, Agent, or Firm*—Kerkam, Stowell, Kondracki & Clarke

[57] ABSTRACT

A rotary internal-combustion engine having a pair of rotor elements fixed to parallel shafts extending coaxially in cylindrical cavities and confronting each other in an intersection region. Each of the rotor elements has a generally cylindrical outer surface spaced from the interior wall of the corresponding cylindrical cavity, and a plurality of sealing vane structures project radially outwardly from the cylindrical outer surfaces to sealingly confront the respective cylindrical cavity interior walls. Between adjacent sealing vane structures combustion charge interspaces and air charge interspaces are alternately defined. The rotor elements are synchronized with respect to each other such that the combustion charge interspaces of one of the rotor elements confront corresponding combustion charge interspaces of the other of the rotor elements. Similarly, the air charge interspaces of the one rotor element confront corresponding air charge interspaces of the other rotor element. Thus, only alternate charges moving through the engine during operation are combustion charges, and the intermediate charges are merely air charges. Enhanced cooling and purging of combustion products results. The cylindrical outer surfaces further include, within the combustion charge interspaces, radially inwardly extending recesses circumferentially located within leading portions of the combustion zone interspaces, these radially inwardly extending recesses defining combustion zones. As a result of this particular location of the combustion zones, the energy resulting from combustion within the engine is effectively directed to provide rotational force.

6 Claims, 8 Drawing Figures

ROTARY INTERNAL COMBUSTION ENGINE

BACKGROUND OF THE INVENTION

The present invention relates to an internal combustion engine having a pair of rotors rotating within a housing and engaging each other to define working chambers within the engine.

One particularly well-known form of rotary engine is a Wankel-type engine defining a combustion or working chamber in cooperation with a fixed sidewall. Another form of rotary engine is a dual-rotor rotary engine, specific examples of which are disclosed in West German "Offenlengungsschrift" No. 2,057,475 (Oct. 21, 1971); Lundstrom et al U.S. Pat. No. 3,777,723; and v. Habsburg-Lothringen U.S. Pat. No. 4,003,349. In each of the engines described in these patents, a working chamber within the engine is defined between cooperating parts of the two rotors.

While rotary engines of the types summarized hereinabove are in general characterized by relatively smooth, high-speed operation, they also in general inherently allow unsymmetrical forces to be generated during the combustion cycle, resulting in more vibration than is necessary. In addition, proper cooling is difficult with some such engines.

SUMMARY OF THE INVENTION

It is an object of the invention to provide a rotary engine which is inherently symmetrical in its operation to the end that the vibration forces are minimized.

It is a related object of the invention to provide a rotary engine characterized by smooth, high-speed operation.

It is another object of the invention to provide a rotary engine having improved cooling characteristics.

It is yet another object of the invention to provide a rotary engine characterized by high efficiency and longevity.

In accordance with the invention, a rotary internal-combustion engine includes a housing defining a pair of parallel cylindrical cavities having interior walls and intersecting each other to define an intersection region. A pair of rotor elements are fixed to parallel shafts extending coaxially in the cylindrical cavities, and these rotor elements confront each other in the intersection region. In order to ensure that the rotor elements rotate smoothly with respect to each other and at the same angular velocity but in opposite directions such that confronting portions of the rotor elements move in generally the same direction within the intersection region, a synchronizing arrangement, such as a gear train, is coupled to the shafts externally of the cylindrical cavities.

Each of the rotor elements more particularly has a generally cylindrical outer surface spaced from the interior wall of the corresponding cylindrical cavity. A plurality of sealing vane structures project radially outwardly from the cylindrical outer surfaces to sealingly confront the respective cylindrical cavity interior walls. For enhanced sealing, the sealing vane structures preferably include grooves on the tips and sides thereof, these grooves being oriented in a direction perpendicular to the direction of movement, thereby serving to create localized turbulence which aids in achieving effective sealing without requiring metal-to-metal contact.

Between adjacent sealing vane structures combustion charge interspaces and air charge interspaces are alternately defined. The rotor elements are synchronized with respect to each other such that the combustion charge interspaces of one of the rotor elements confront corresponding combustion charge interspaces of the other of the rotor elements. Similarly, the air charge interspaces of the one rotor element confront corresponding air charge interspaces of the other rotor element.

Thus, an important feature of the subject engine is that only alternate charges moving through the engine during operation are combustion charges, and the intermediate charges are merely air charges. Enhanced cooling and purging of combustion products with high-velocity air results.

In a preferred embodiment of the invention, each of the rotor elements has three combustion charge interspaces, three air charge interspaces, and six sealing vane structures. Thus, the subject rotary engine in some respects may be compared to a two-stroke cycle, three-cylinder engine.

In order to precisely define combustion zones, the shafts of the two rotor elements are spaced a distance such that, within the combustion charge interspaces, the rotor element cylindrical outer surfaces closely confront each other. These cylindrical outer surfaces further include, within the combustion charge interspaces, radially inwardly extending recesses circumferentially located within leading portions of the combustion zone interspaces, these radially inwardly extending recesses defining the combustion zones. As a result of this particular location of the combustion zones, the energy resulting from the combustion within the engine is effectively directed to provide rotational force.

Moreover, this particular combustion zone arrangement inherently balances the forces of combustion between the two rotors, resulting in smooth operation. In particular, the two rotors are substantially identical in the sense that the radial distance between the radially-innermost portion of the combustion zone recesses (i.e. the "bottoms" of these recesses) and the rotor shaft is the same for each rotor.

To complete the engine structure, intake ports are provided for introducing air into the combustion charge interspaces and into the air charge interspaces at a point ahead of the intersection region as the rotors rotate. Similarly, exhaust ports are provided for discharging combustion products from the combustion charge interspaces and for discharging air from the air charge interspaces a point following the intersection region as the rotors rotate.

An injector is provided for injecting fuel into the conduction charge interspaces to form a fuel/air mixture, and an igniter is provided for igniting the fuel/air mixture within the combustion zones.

BRIEF DESCRIPTION OF THE DRAWINGS

While the novel features of the invention are set forth with particularity in the appended claims, the invention, both as to organization and to content, will be better understood and appreciated, along with other objects and features thereof, from the following detailed description taken in conjunction with the drawings, in which:

DETAILED DESCRIPTION

Figure 1:
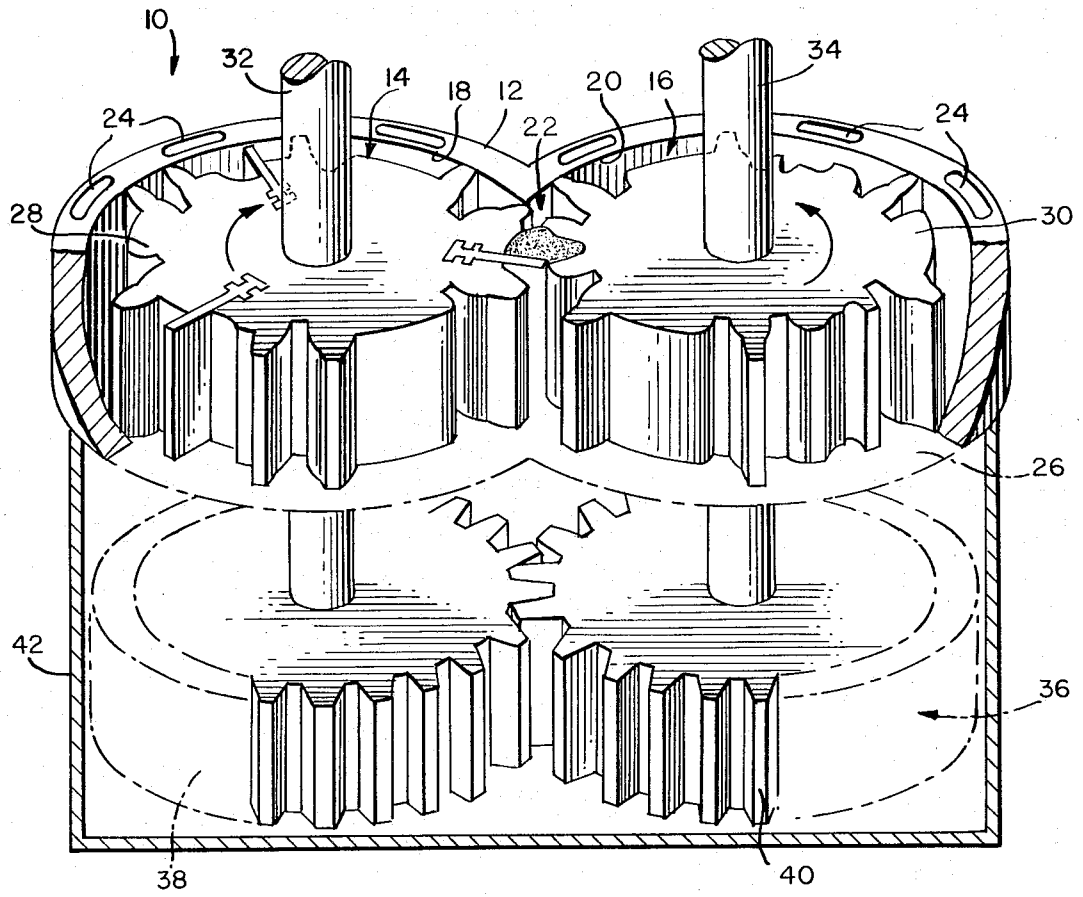
FIG. 1 is a highly-schematic overall three-dimensional view of the one embodiment of rotary engine in accordance with the invention.

Referring first to FIG. 1, a rotary internal combustion engine 10 includes a housing 12 defining a pair of parallel cylindrical cavities 14 and 16 having respective at least semi-cylindrical interior wall surfaces 18 and 20. The cavities 14 and 16 intersect or, in other words, overlap each other to define an intersection region, generally designated 22. Passageways 24 for coolant are formed within the cavity walls.

It will be appeciated that the cylindrical cavities 14 and 16 are bounded in an axial direction by lower wall 26 and an upper cover plate (not shown).

Arranged for rotation within the cylindrical cavities 14 and 16 are a pair of rotor elements 28 and 30 fixed to respective parallel shafts 32 and 34 extending coaxially within the respective cylindrical cavities 14 and 16. The rotor elements 28 and 30 confront each other within the intersection region 22.

In order to ensure that the rotor elements 28 and 30 rotate smoothly with respect to each other and at the same angular velocity, a synchronizing arrangement 36 comprising representative spur gears 38 and 40 is included within a lower housing 42 immediately adjacent the lower wall 26 of the housing 12. The gears 38 and 40 are also fixed to the respective shafts 32 and 34. Thus, within the intersection region 22, the rotors 28 and 30 rotate at the same angular velocity and move in generally the same direction.

It will be appreciated that a number of conventional elements such as bearings, fasteners, and the like are required. These, however, are omitted for clarity of illustration. Similarly, it will be appreciated that, although both shafts 32 and 34 are shown extending upwardly, in practice only one of these shafts is required to extend out of the engine 10 as an output shaft.

Further details of the engine 10, as well as the operational cycle thereof, will be apparent from the following description with reference to FIGS. 2, 3, 4 and 6, which generally depict the rotors 28 and 30 rotating within the respective cavities 14 and 16.

The rotors 28 and 30 more particularly comprise generally cylindrical outer surfaces 46 and 48 as hereinafter described.

Considering these in detail, the rotors 28 and 30 each have a plurality of sealing vane structures designated generally 50*a*–50*f* in the case of the rotor 28, and 52*a*–52*f* in the case of the rotor 30. These sealing vane structures 50*a*–50*f* and 52*a*–52*f* project radially outwardly from the respective cylindrical outer surfaces 46 and 48 to sealingly confront the respective cylindrical cavity interior wall 18 or 20. In the illustrated embodiment, each of the rotors 28 and 30 has six such sealing vane structures 50*a*–50*f* and 52*a*–52*f*, thus defining six interspaces between each set of sealing vane structures 50*a*–50*f* and 52*a*–52*f*. From the FIGS. it will be seen that the sealing vane structures 50*a*–50*f* and 52*a*–52*f* of each rotor resemble gears and mate with those of the opposite rotor.

In accordance with the invention, only half of the defined interspaces are combustion charge interspaces. These combustion charge interspaces are designated 54*a*–54*c* in the case of the rotor 28, and 56*a*–56*c* in the case of rotor 30. The alternate interspaces are air charge interspaces, designated 58*a*–58*c* in the case rotor 28, and 60*a*–60*c* in the case of rotor 30. The rotor elements 28 and 30 are synchronized by the synchronizing arrangement 36 such that the combustion charge interspaces 54*a*–54*c* of the rotor 28 confront corresponding combustion charge interspaces 56*a*–56*c* of the rotor element 30, and such that the air charge interspaces 58*a*–58*c* of the rotor 28 confront corresponding air charge interspaces 60*a*–60*c* of the rotor 30.

Figure 5:
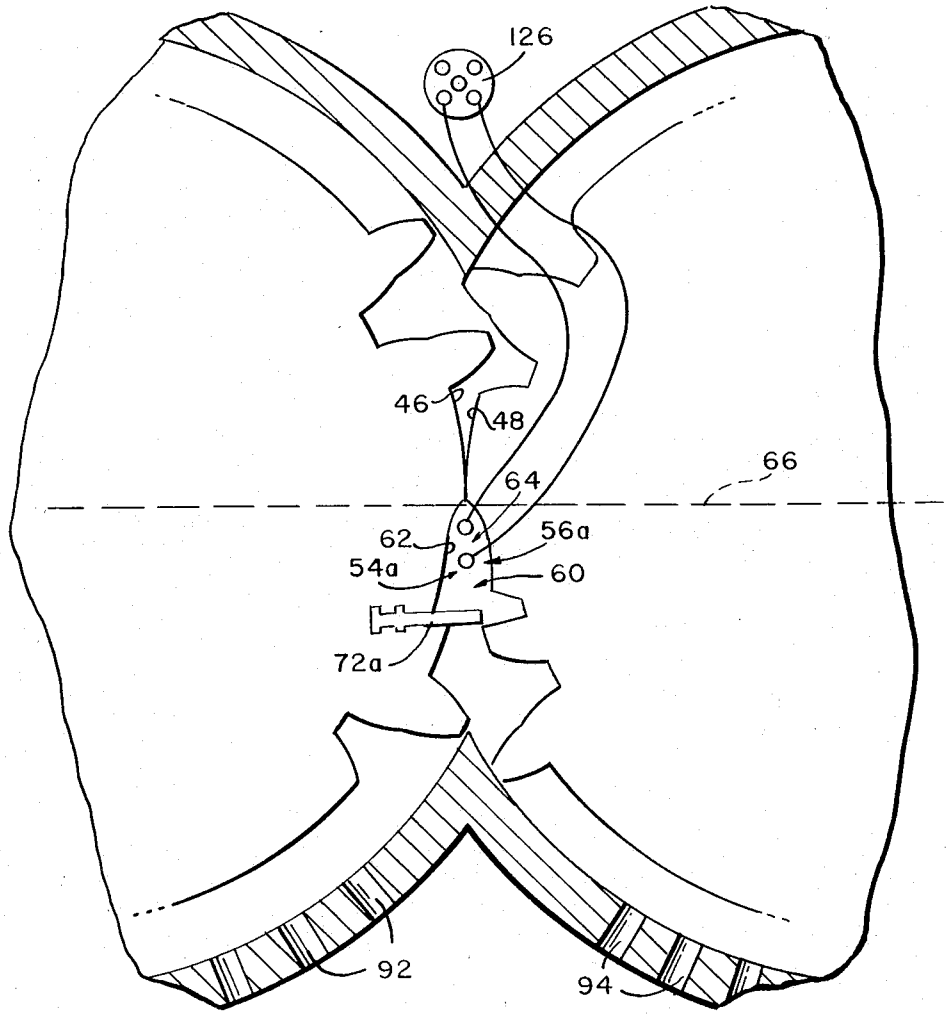
FIG. 5 is an enlarged view of a portion of FIG. 4, depicting further details of the combustion zone.

The rotor element shafts 32 and 34 are spaced a distance such that within the intersection region 22 the combustion charge interspaces 54*a*–54*c* and 56*a*–56*c* of the rotor element cylindrical outer surfaces 46 and 48 closely confront each other in essentially sealing relationship, as may best be seen from FIG. 5. In addition to facilitating sealing, this spacing causes compression to occur as a particular charge is carried into the intersection region 22.

Referring to FIG. 5 in detail, in order to define combustion zones, such as exemplary combustion zone 60, the cylindrical outer surfaces 46 and 48 include radially inwardly extending recesses 62 and 64 within the combustion charge interspaces 54*a*–54*c* and 56*a*–56*c*. So that energy resulting from combustion within the engine is effectively directed to provide rotational force, the recesses 62 and 64 are circumferentially located within leading portions of the combustion charge interspaces 54*a*–54*c* and 56*a*–56*c*. This aspect of the rotary engine 10 is represented in FIG. 5 by means of a horizontal line 66 passing through a centerline between the rotor shafts 32 and 34. This line 66 may be considered as representing the "top dead center" (TDC) orientation of the rotors 28 and 30.

Figure 4:
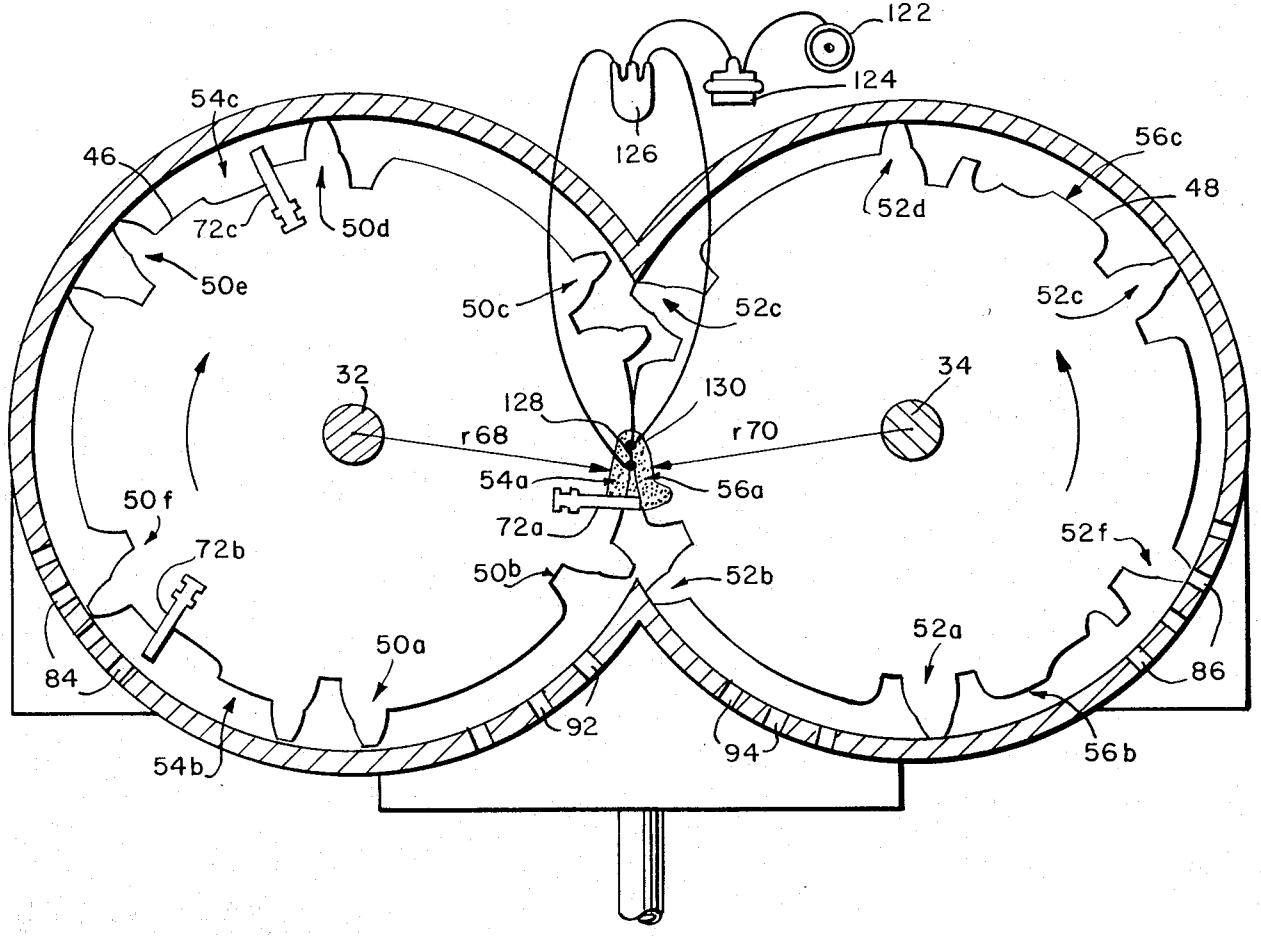
FIG. 4 is a similar view depicting the moment of ignition and beginning of combustion.

Another feature of the engine 10, best seen in FIG. 4, is that the radial distance $r_{68}$ between the intermost portion of the combustion zone recess 62 of the rotor element 28 and the corresponding rotor shaft 38 is substantially identical to the corresponding radial distance $r_{70}$ between the radially innermost portion of the combustion zone recess 64 of the other rotor element 30 and its corresponding shaft 34. As a result, the forces of combustion are symmetrically balanced between the two rotors 28 and 30, resulting in quieter and smoother operation.

Still considering the details in the combustion zone 60, and referring again to FIG. 5, to aid in defining the combustion 60 at the actual moment of combustion, carried by the rotor element 28 are auxiliary elements 72*a*–72*c* which comprise relatively thin, slightly flexible strips of metal capable of withstanding the high temperatures involved. These elements 72*a*–72*c* preferably are made of high grade carbon steel or titanium, such as is employed in jet engines, and are slightly resilient. The elements 72*a*–72*c* are suitably anchored within the cylindrical outer surface 46 of the rotor 28.

For maintenance purposes, a covered access hole (not shown) can be provided to facilitate inspection and replacement, if necessary, of the elements 72*a*–72*c*.

Final elements of the structure of the engine 10 are intake ports 84 and 86 formed within the walls of the cavities 14 and 16 and supplied from suitable intake manifolds 88 and 90. These ports 84 and 86 serve to introduce air into the combustion charge interspaces 54*a*–54*c* and 56*a*–56*c*, and into the air charge interspaces 58*a*–58*c* and 60*a*–60*c* at a point ahead of the intersection region 22 as the rotors 28 and 30 rotate. Similarly, exhaust ports 92 and 94 are formed within the walls of the cavities 14 and 16 and connected to a common exhaust manifold 96. These exhaust ports 92 and 94 are located following the intersection region 22 as the rotors 28 and 30 rotate and serve to discharge combustion products from the combustion charge interspaces 54*a*–54*c* and 56*a*–56*c*, and to discharge cooling air from the air charge interspaces 58*a*–58*c* and 60*a*–60*c*.

For introducing fuel into the engine, a suitable fuel injection arrangement, generally designated 100 (FIG. 3) is provided. More particularly, the fuel injection arrangement 100 comprises a fuel reservoir 102, a suitably timed fuel injection pump 104 of conventional construction, and a "Y" connector 106 supplying, via conduits 108 and 110, a pair of fuel injection nozzles 112 and 114. The fuel injection nozzles 112 and 114 are recessed within the lower wall 26 and upper cover plate (not shown) and direct the fuel from opposite sides in an axial direction to form a fuel/air mixture.

A high-energy ignition system 120 is included as is represented in FIG. 4, and comprises a solid-state switch 122, an ignition coil 124 and a distributor 126 supplying dual igniters 128 and 130, mounted in a manner similar to the fuel injectors 112 and 114.

Figures 7, 8:
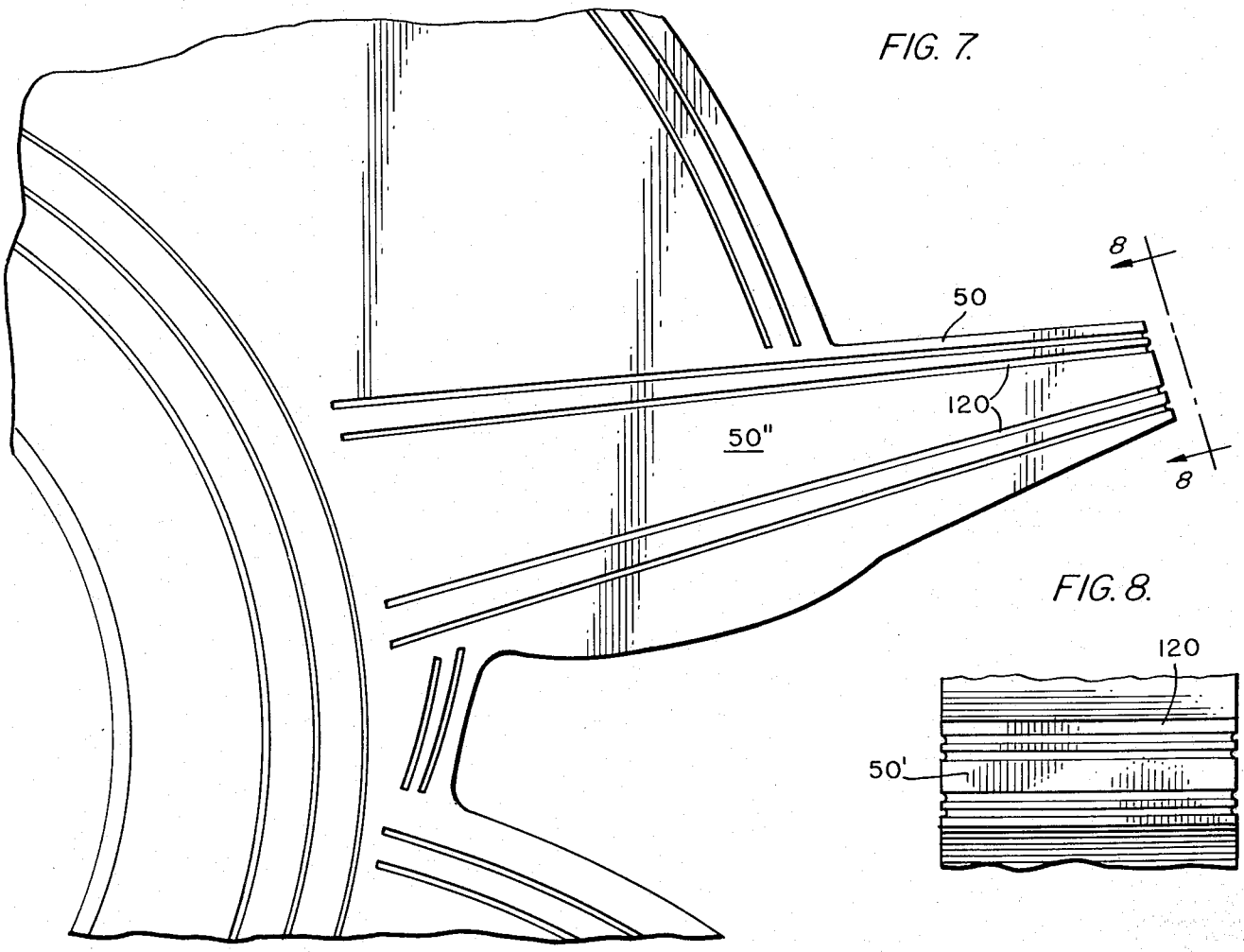
FIG. 7 is a greatly enlarged view of a representative vane depicting the slots which create turbulence to aid in sealing.
FIG. 8 is an end view of one of the sealing vane tips taken along line 8—8 of FIG. 7.

Referring to FIGS. 7 and 8, for enhanced sealing the sealing vane structures 50*a*–50*f* and 52*a*–52*f* have grooves 120 formed on the tips 50' and sides 50'' thereof, as shown on the representative sealing vane 50. These grooves 120 are oriented in a direction generally perpendicular to the direction of motion, and serve to create localized turbulence with aids in sealing. Similar grooves 122 are preferably provided at other locations on the rotors 28 and 30 as depicted in FIG. 7.

Figure 2:
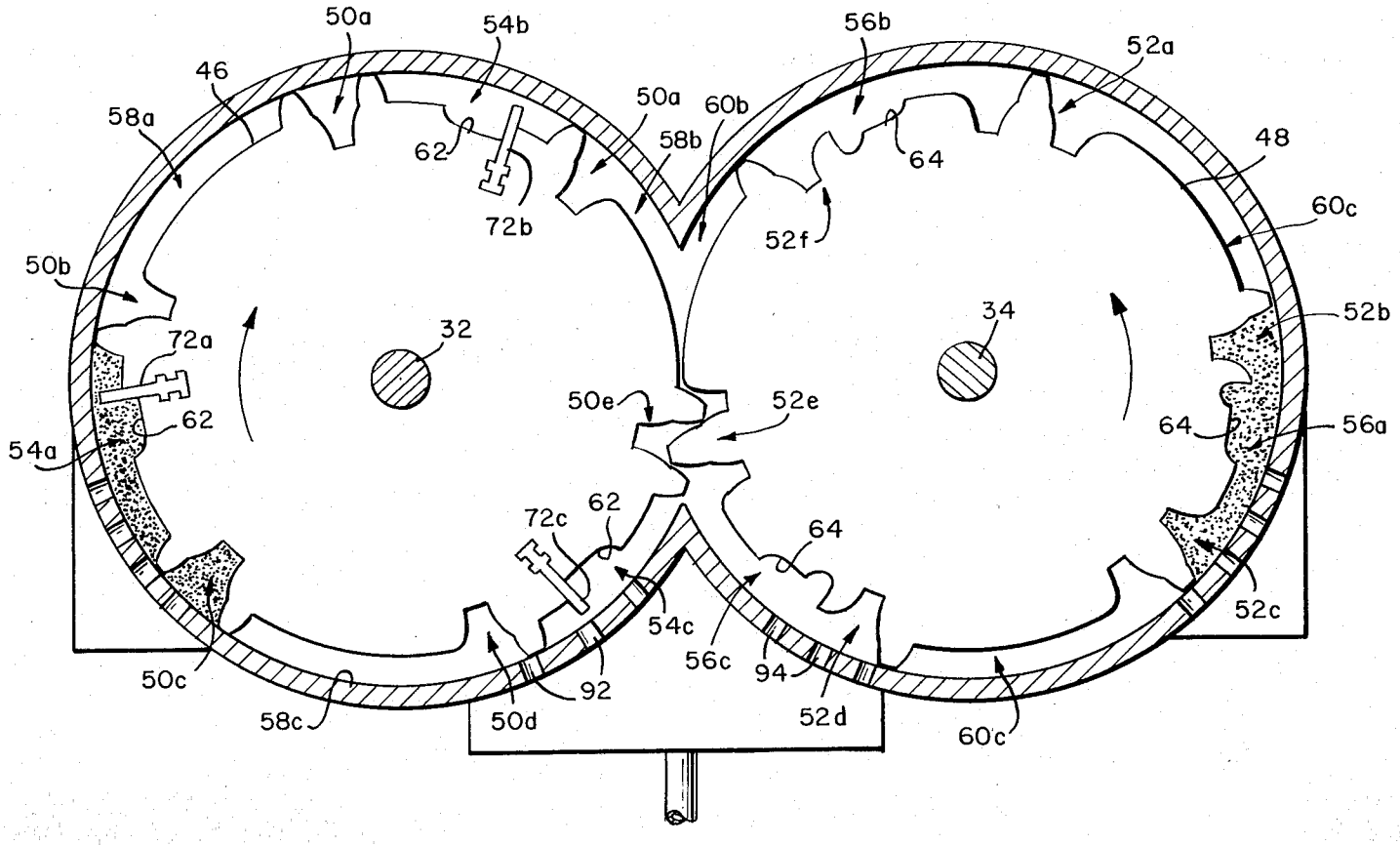
FIG. 2 is a simplified plan view depicting the beginning of an operational sequence, in particular, air induction.
Figure 3:
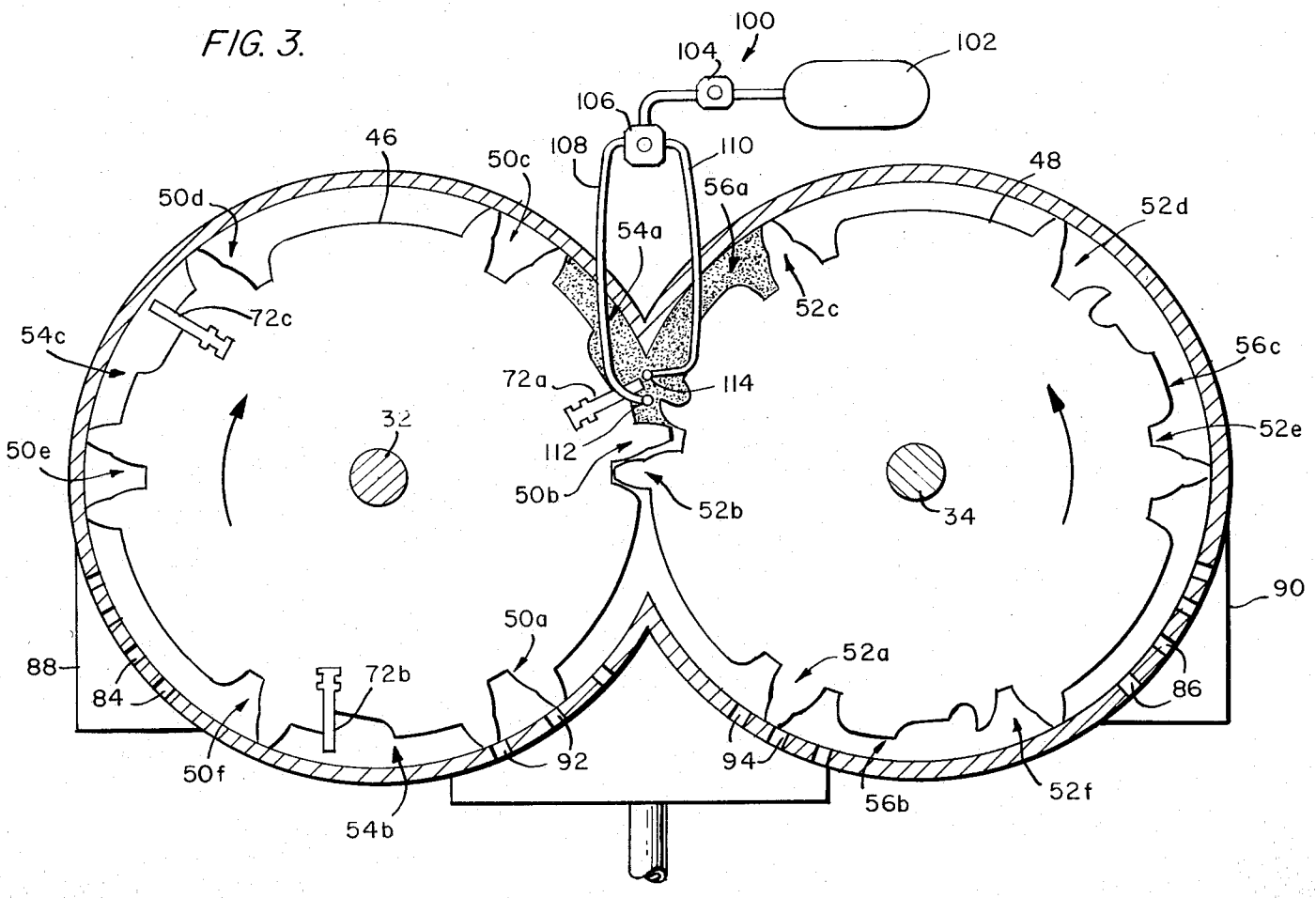
FIG. 3 is a similar view depicting the beginning of the compression portion of the cycle, as well as fuel injection.

Considering now the operation, the air intake portion of the cycle is shown in FIG. 2, wherein combustion air charges are being drawn into the combustion charged interspaces 54*a* and 56*a* through the intake ports 84 and 86. The rotors 28 and 30 continue to rotate in the direction indicated, until the position of FIG. 3 is reached. FIG. 3 depicts the beginning of compression, and fuel injection. Compression occurs due to the overlapping nature of the cavities 14 and 16 within the intersection region 22.

Next, as depicted in FIG. 4, ignition and combustion occur as a result of appropriately-timed activation of igniters 128 and 130. The combusting gas rapidly expands, driving the rotors 28 and 30 in the direction indicated.

Figure 6:
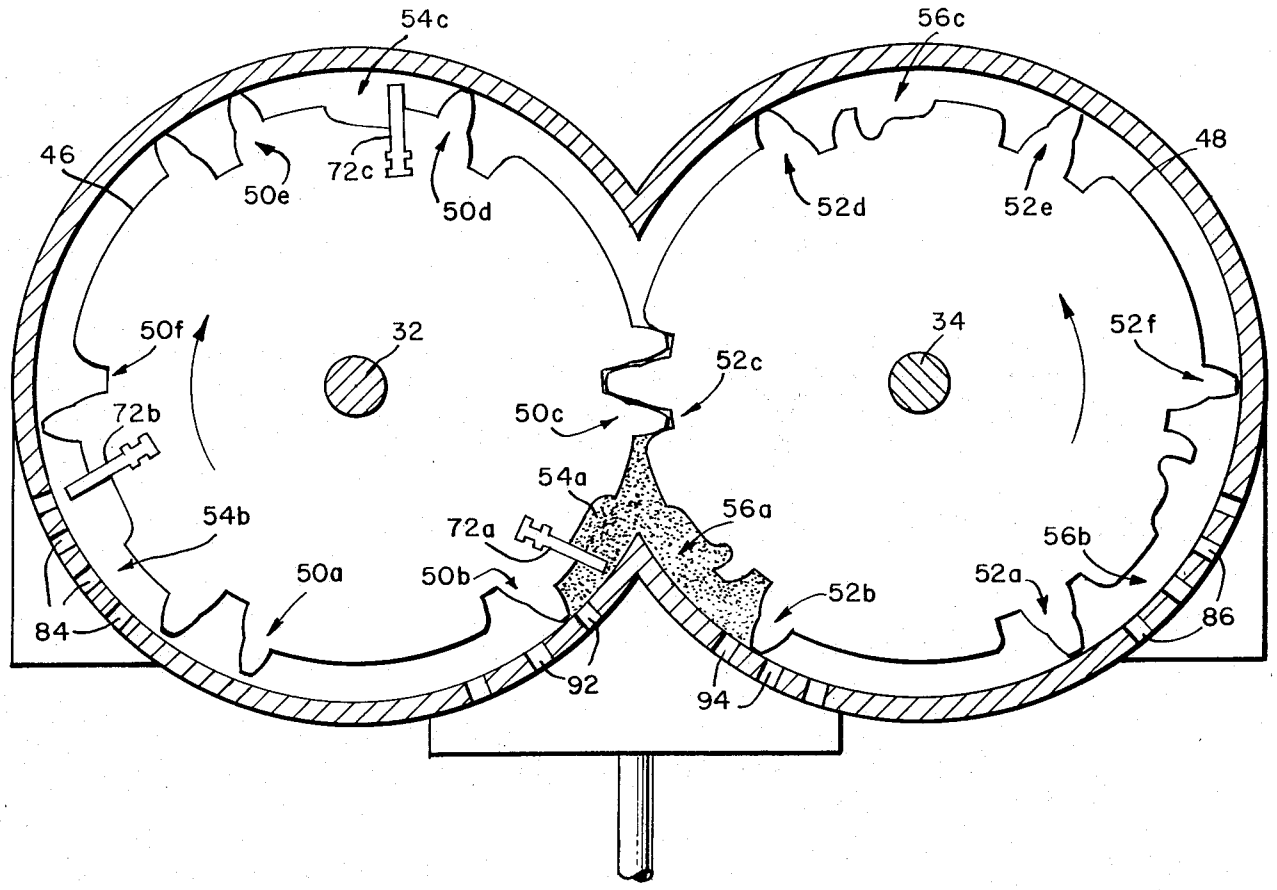
FIG. 6 is a view similar to FIGS. 2, 3 and 4 depicting the exhaust portion of a cycle.

Finally, the exhaust portion of the cycle as depicted in FIG. 6 is reached, and the combustion products exit the engine through the exhaust ports 92 and 94.

It will be appreciated that, although the progress of a representative combustion charge is depicted in FIGS. 2, 3, 4 and 6, the other combustion charge interspaces 54*b*–54*c* and 56*b*–56*c* are likewise functioning, and that the air charge interspaces 58*a*–58*c* and 60*a*–60*c* are carrying mere air charges through the engine. These mere air charges to not actually combust. They do, however, provide for a purging cycle of high velocity air which moves through the engine and out directly after the exhaust stroke.

Despite the high velocity purging air and the sealing vane structures, there is a slight amount of exhaust gas which re-enters the intake sections. This, however, presents no problem inasmuch as this re-entering exhaust gas is picked up, circulated, and is burned when mixed with incoming air and fuel.

In view of the foregoing, it will be appreciated that the present invention provides a rotary engine characterized by smooth, high-speed and efficient operation, having enhanced cooling, and wherein the forces of vibration are minimized.

While specific embodiments of the invention have been illustrated and described herein, it is realized that modifications and changes will occur to those skilled in the art. It is therefore to be understood that the appended claims are intended to cover all such modifications and changes as fall within the true spirit and scope of the invention.

What is claimed is:

1. A rotary internal-combustion engine comprising:

a housing defining a pair of parallel cylindrical cavities having interior walls and intersecting each other to define an intersection region;

a pair of rotor elements fixed to parallel shafts extending coaxially in said cylindrical cavities and confronting each other in said intersection region;

a synchronizing arrangement coupled to said shafts externally of said cylindrical cavities for ensuring that said rotor elements rotate smoothly with respect to each other and at the same angular velocity but in opposite directions such that confronting portions of said rotor elements move in generally the same direction within said intersection region;

each of said rotor elements having a generally cylindrical outer surface spaced from the interior wall of the corresponding cylindrical cavity and having a plurality of sealing vane structures projecting radially outwardly from said cylindrical outer surfaces to sealingly confront the respective cylindrical cavity interior wall;

combustion charge interspaces and air charge interspaces being alternately defined between adjacent sealing vane structures, and said rotor elements being sychronized such that the combustion charge interspaces of one of said rotor elements confront corresponding combustion charge interspaces of the other of said rotor elements, and such that the air charge interspaces of the one rotor element confront corresponding air charge interspaces of the other rotor element;

said shafts of said rotor elements being spaced a distance such that within said combustion charge interspaces said rotor element cylindrical outer surfaces closely confront each other, and said cylindrical outer surfaces further including radially inwardly extending recesses within said combustion charge interspaces circumferentially located within leading portions of said combustion charge interspaces to define combustion zones;

intake ports for introducing air into said combustion charge interspaces and into said air charge interspaces at a point ahead of said intersection region as said rotors rotate;

exhaust ports for discharging combustion products from said combustion charge interspaces and air from said air charge interspaces at a point following said intersection region as said rotors rotate;

an injector for injecting fuel into said combustion charge interspaces only so as to form a fuel/air mixture; and an ignitor for igniting the fuel/air mixture within the combustion zones.

2. A rotary internal-combustion engine in accordance with claim 1, wherein each of said rotor elements has three combustion charge interspaces, three air charge interspaces, and six sealing vane structures.

3. A rotary internal-combustion engine in accordance with claim 1, wherein the radial distance between the radially-innermost portion of the combustion zone recesses and the rotor shaft is the same for each rotor such that forces of combustion are balanced between the two rotors.

4. A rotary internal-combustion engine in accordance with claim 2, wherein the radial distance between the radially-innermost portion of the combustion zone recesses and the rotor shaft is the same for each rotor such that forces of combustion are balanced between the two rotors.

5. A rotary internal-combustion engine in accordance with claim 1, wherein said sealing vane structures include grooves on the tips and sides thereof, oriented in a direction perpendicular to the direction of motion, said grooves serving to create localized turbulence to aid sealing.

6. A rotary internal-combustion engine in accordance with claim 2, wherein said sealing vane structures include grooves on the tips and sides thereof oriented in a direction perpendicular to the direction of movement, said grooves serving to create localized turbulence to aid in sealing.

* * * * *